US008544404B2

(12) United States Patent
Santos Costa et al.

(10) Patent No.: US 8,544,404 B2
(45) Date of Patent: Oct. 1, 2013

(54) MONO-COLUMN FPSO

(75) Inventors: Ana Paula dos Santos Costa, Rio de Janeiro (BR); Isaias Quaresma Masetti, Rio de Janeiro (BR); Vinicius Leal Ferreira Matos, Rio de Janeiro (BR); Kazuo Nishimoto, Sao Paulo (BR); Gerson Machado, Sao Paulo (BR)

(73) Assignee: Pertoleo Brasileiro S.A.—Petrobras, Rio de Janeiro (BR)

( * ) Notice: Subject to any disclaimer, the term of this patent is extended or adjusted under 35 U.S.C. 154(b) by 371 days.

(21) Appl. No.: 12/294,192

(22) PCT Filed: Apr. 13, 2007

(86) PCT No.: PCT/GB2007/001367

§ 371 (c)(1),
(2), (4) Date: Mar. 24, 2010

(87) PCT Pub. No.: WO2007/119051

PCT Pub. Date: Oct. 25, 2007

(65) Prior Publication Data

US 2010/0288177 A1 Nov. 18, 2010

(30) Foreign Application Priority Data

Apr. 17, 2006 (BR) ..... 0601273

(51) Int. Cl.
*B65D 88/78* (2006.01)

(52) U.S. Cl.
USPC ..... 114/256

(58) Field of Classification Search
USPC ..... 114/256, 257, 258, 259, 260, 261, 114/262, 263–267; 405/224, 223.1, 205, 405/203, 200, 204, 224.2
See application file for complete search history.

(56) References Cited

U.S. PATENT DOCUMENTS

| | | | | |
|---|---|---|---|---|
| 3,537,412 | A | 11/1970 | Henderson et al. | |
| 4,048,943 | A * | 9/1977 | Gerwick, Jr. | 114/256 |
| 4,176,614 | A | 12/1979 | Goss et al. | |
| 4,582,014 | A | 4/1986 | Patel | |
| 4,606,673 | A * | 8/1986 | Daniell | 405/210 |
| 6,945,736 | B2 * | 9/2005 | Smedal et al. | 405/203 |
| 7,086,810 | B2 * | 8/2006 | Masetti et al. | 405/224 |
| 7,958,835 | B2 * | 6/2011 | Srinivasan | 114/264 |

FOREIGN PATENT DOCUMENTS

| | | |
|---|---|---|
| FR | 2 681 831 A1 | 4/1993 |
| WO | 97/06340 A | 2/1997 |

OTHER PUBLICATIONS

USA Code of Federal Regulations Part 153, Subpart B § 153.208 Sep. 26, 1977, as amended May 17, 1982.
Canada Oil and Gas Installations Regulations, SOR/96-118, Ballast and Bilge Systems § 58, Feb. 13, 1996.
Syvertsen, Kare and Lopes, Clovis of Seven Marine, Offshore Magazine, The SSP: A New Class of Hull for the Oil Industry, Apr. 2004, vol. 64 Issue 4, p. 36.

* cited by examiner

*Primary Examiner* — Daniel Venne
(74) *Attorney, Agent, or Firm* — Sughrue Mion, PLLC

(57) ABSTRACT

This invention relates to a platform of the FPSO type in the form of a mono-column, of circular or polygonal horizontal section or of a combination of circular and polygonal sections, comprising one or more central load tanks (12), which can be single or compartmented, surrounded, in an alternately and uniformly distributed manner, by permanent-ballast tanks (13) and by ballast tanks open to the sea ("moonpools") (14).

7 Claims, 7 Drawing Sheets

MONO-COLUMN FPSO

FIELD OF THE INVENTION

This invention relates to a Floating Production, Storage and Offloading (FPSO) structure for marine petroleum exploitation in deep or ultra-deep waters, in the form of a mono-column, which is provided with means for storing the oil produced, which means are distributed in a manner that renders the platform more stable in its movements, even in adverse sea conditions.

More specifically, the invention relates to improvements to the construction of mono-column platforms which use a floating structure of the type which comprises a rotationally symmetrical body formed by (a) a submerged lower portion, provided with an external peripheral protuberance capable of retaining a mass of water which is in contact with its surface, generating a damping force which opposes the displacement of the structure due to waves and currents and (b) an upper portion above sea-level, on which a deck for holding petroleum drilling and/or production equipment can be installed. The above-mentioned body comprises, in addition, ballast tanks, which are located in a compartmented manner, both in the lower portion and in the upper portion of the hull. The lower portion of the rotationally symmetrical body has an internal void ("moonpool") which acts as a damper of the movements caused by the waves and through which the risers which convey the fluids produced by the wells on the sea floor can pass.

The uniform application of damping means and the number and arrangement of the tanks give the structure functional features which are beneficial for this type of hull.

BACKGROUND OF THE INVENTION

The discovery of petroleum production fields, situated at sea, in deep and ultra-deep waters (water layers exceeding 2,000 meters in depth), calls for the use of floating structures with a capacity and strength for receiving equipment and installations necessary for its exploitation and production. These floating structures (or Stationary Production Units—SPUs) are connected to risers for production and export of the fluids produced by the wells, the former being subject to the action of sea currents.

Due to the increase in the depth of the water layer, the production capacity of the wells and the safety requirements for operating in these regions, the search for technical solutions for facing the challenges becomes increasingly complex, which can raise the costs involved hugely to the point of making a whole enterprise unviable.

One of the main challenges to be faced relates to the load to be supported by the floating structure, hence the emergence of various innovative embodiments connected with the choice of the most suitable type of structure and with the anchoring systems not only of the floating structures themselves but also of the production risers. However, most of the innovations apply to conventional structures such as semi-submersible rigs and tankers.

The principal feature of semi-submersible rigs is that they remain in a substantially stable position after being anchored and have small movements under the action of environmental forces such as, for example, wind, waves and sea currents. Nevertheless, these rigs have limited capacity for receiving loads, which impedes their use for installing equipment used in processing plants or for storing large quantities of oil. Another factor to be considered is the complexity of constructing their hulls, which requires a construction technique which is different, specialized and not very flexible regarding design changes, with reflex actions which significantly burden the design work.

On the other hand, the use of tankers, adapted for receiving production plants on their decks has been a fairly well used alternative, as these ships have large storage capacities. However, the question of load distribution in terms of the place for installation of the equipment and the structure of the tanker form one of the main problems for this type of structure, which has to be very well evaluated.

More recently, deep-draught structures of the mono-column type, known by persons skilled in the art as SPAR type platforms, have been proposed. These enormous platforms include, in general, a large cylinder supporting the installations and equipment; the cylinder is moored to the sea floor with cables and lines. This type of structure is designed to to undergo few movements and to be used in deep waters. However, it has the drawback of having a draught which is very great in length and a small surface area for accommodating installations, which makes it difficult to fit the installations normally necessary on its deck and to transport it to the oil production site. It therefore requires installation of the deck to be carried is out on the open sea, burdening the project due to the need for various different sea support auxiliary vessels to be used, these being highly sophisticated and of high operational cost.

DESCRIPTION OF THE PRIOR ART

From among the attempts at a solution to the above-mentioned problems, we now discuss some previous proposals.

A first proposal is described in patent document JP 1994/056074, published on 1 Mar. 1994, in which a floating marine structure, made up of a hull in the form of a disc and cylindrical columns installed on the upper part of this hull, is presented; the said columns comprise, inside, internal water compartments, which are connected with the external water by means of a water conveying opening provided in the hull. The peripheral surface of the hull is provided with inclined vanes opening below, which affords reduction of oscillation of the structure, making it capable of being used in leisure installations, hotels and the like. The structure as described does not meet the conditions of working in deep or ultra-deep waters.

In patent document U.S. Pat. No. 6,113,314, of 5 Sep. 2000, a method for rapid disconnection of a floating structure kept in a positive state of flotation, known by persons skilled in the art as a platform of the TLP ("Tension Leg Platform") type is shown. This type of platform includes a floating structure with a high degree of stability, kept in position with tensioned cables anchored to the sea floor and connected to a submerged floating connection head. The production platform described in this document has the production facilities installed on the top of the structure to and a production vessel with high storage capacity, being capable of receiving the oil produced by various production wells for subsequent transfer to a tanker. The production vessel is preferentially of cylindrical form, being capable of including inner chambers distributed around a central core, for storing crude oil and natural gas, as well as outer chambers connected to the central core by segregation walls, for storing seawater or air, ensuring the ballast of the structure. The production vessel is constructed with the use of techniques applied to reinforced concrete to ensure the stability of the structure and strength for combating very bad weather and collision with icebergs and other threats.

Another proposal, presented in patent document WO 02/090177, published on 14 Nov. 2002, describes a type of platform which consists of a semi-submersible body capable of supporting, on its upper surface, the equipment for drilling for and/or producing hydrocarbons at sea. The main body of the platform is preferentially of cylindrical form, having a flat bottom, provided with peripheral cuts in its lower portion, in the section situated below the platform's center of gravity. The cylindrical body is provided with a central opening, through which the equipment necessary for production and the risers for production and export of the fluids produced pass. Around the central opening, storage tanks and, further out, ballast tanks, are distributed.

U.S. Pat. No. 6,340,272, of 22 Jan. 2002, shows a method of constructing a marine platform which combines a self-floating deck structure with a self-floating sub-structure, the self-floating deck structure possibly being a floating pier or a barge, on which the equipment has been installed. The structures are taken to the site separately, where they are coupled together; the sub-structure is partially submerged and the pier or barge is positioned over it; the ballast is removed from the sub-structure to create a vertical force of coupling between the sub-structure and the floating pier. The method has the advantage of reducing the time for construction of the structure and cost commissioned, as well as the construction cost due to the increase in complexity of the decks. The principal aim of the method is to reduce the costs associated with the project such as, for example, the cost for temporary use of a construction pier, use of barges for transporting the structure to the production site, damage to the structure due to mistakes made during transport operations, etc.

In patent document WO 03/064246, published on 7 Aug. 2003, a SPAR type structure is presented, the floating hull of which is formed by a plurality of cells, sub-divided into compartments, the flotation of which is controlled by fixed and/or variable ballast. The cells can be made in different ways and have different forms. The ballasts can be arranged on or in the cells to adjust flotation, save space and promote the stability of the structure. Even so, the problems caused by the size of the structure, mainly the deep draught required, are not completely solved.

The proposal described in patent document BR 0300265-9, published on 28 Dec. 2004, presents a floating structure for marine installations for production of or drilling for petroleum at sea, for use in deep or ultra-deep waters, which is formed from a body with rotational symmetry in relation to the vertical axis, comprising a central opening and having two different portions: an upper portion above sea-level, of cylindrical or polygonal shape, prepared for holding, on its upper part, a deck provided with all the installations necessary for the drilling or production operations, a lower portion with external dimensions greater than the dimensions of the upper portion, the two portions connecting so as to form an external profile shaping a transition zone inclined downwards. The transition zone is responsible for the control of the oscillations which cause the inclination of the structure according to the movements of the sea waves. The internal void and the lower opening act as a means of limiting the structure's vertical movements ("heave"), allowing the risers to pass through its interior and to be connected to the platform structure, ensuring a significant reduction in the tensions at the connection points. The structure can be constructed in modules, which can be connected to one another to form a true production island, the movements of which are minimized, affording greater flexibility in the choice of the means of is receiving and exporting the production, as well as a significant reduction in project costs.

Unlike the SPAR-type platforms, this type of platform has a shallow draught and a large surface area for installing the equipment, which greatly assists its construction and installation.

SUMMARY OF THE INVENTION

This invention relates to a platform of the FPSO type in the form of a mono-column, preferably of circular or polygonal horizontal cross section, or a combination of circular and polygonal horizontal cross section, comprising a central load tank, which can be single or compartmented, surrounded, in an alternately and uniformly distributed way, by permanent-ballast tanks and by ballast tanks open to the sea ("moon-pools"). The external geometry of the unit is chosen so as to give the greatest effect of mitigation of angular movements ("pitch") and vertical movements ("heave") of the unit and to simplify the placing of a deck on the hull, while the internal geometry of this arrangement of the tanks, in joint action with the above-mentioned storage and ballast tanks, improves its efficiency with regard to attenuation of the movements induced by sea waves.

BRIEF DESCRIPTION OF THE FIGURES

The invention will now be further described, by way of example only, with reference to the accompanying drawings in which:—

DETAILED DESCRIPTION OF THE INVENTION

In order for the invention to be better understood, a description of embodiments will be given in conjunction with the accompanying Figures.

Figure 1:
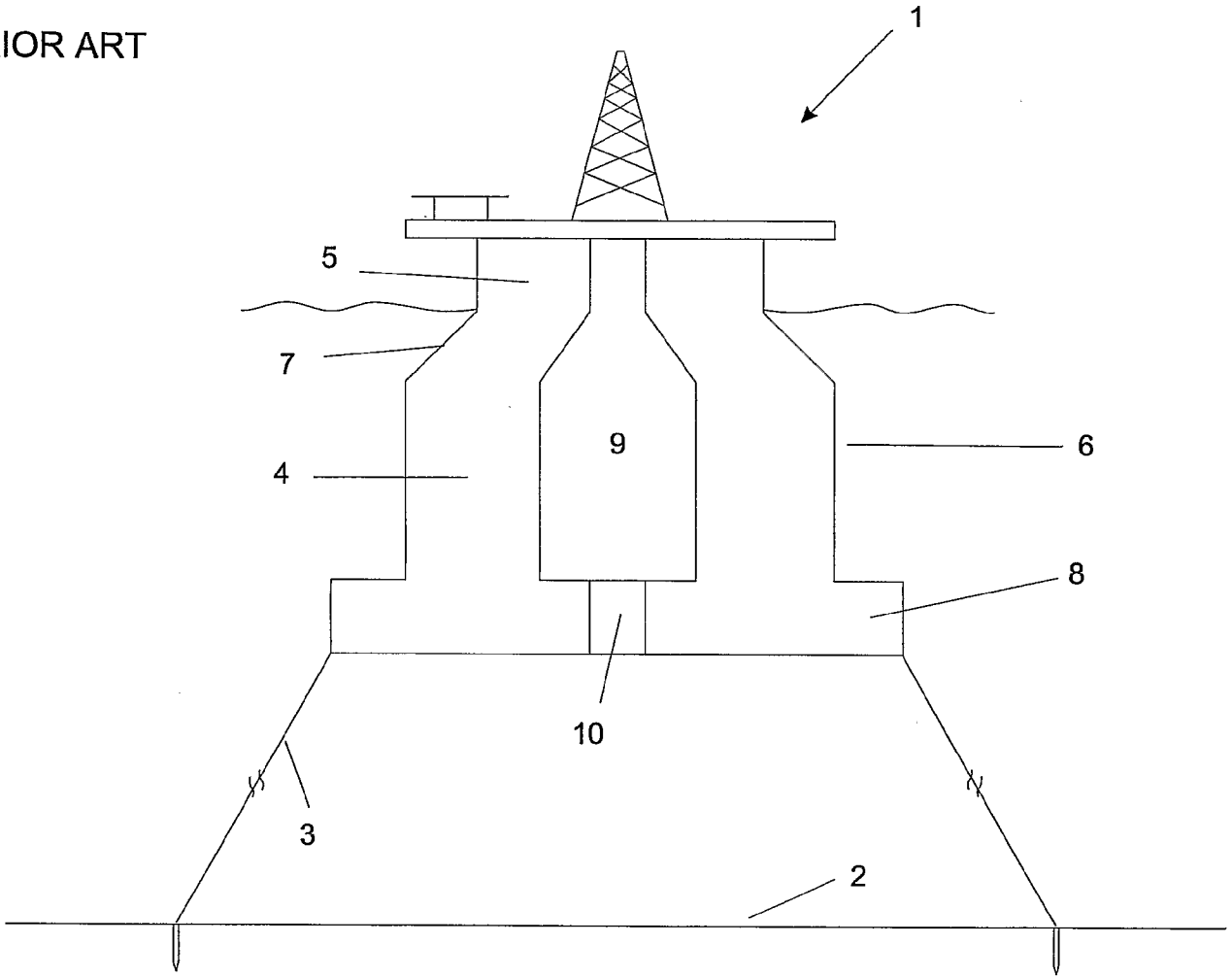
Fig. 1 PRIOR ART
FIG. 1 shows, in schematic form, a mono-column type platform of the prior art.

Various different proposals for the construction of platforms which are for operating in deep waters, capable of storing large quantities of oil and provided with great stability, are known from the prior art. The type of floating structure (or hull) presented in Brazilian patent application PI 0300265-9 of 31 Jan. 2003, which is shown schematically in FIG. 1, is particularly interesting.

As can be noted, the floating structure (1) has a shallow draught and a large diameter, which immediately differentiates it from a SPAR-type platform. The structure can be fastened to the sea floor (2) by means of anchoring lines (3) which are connected at different points of its external surface, as appropriate and according to sea conditions.

The main body (4) of the structure is presented in symmetrical form in relation to a vertical axis and can be of cylindrical or polygonal form. Externally, it has an upper portion (5), of smaller diameter, which remains above sea-level and a lower portion (6), of greater diameter, which remains submerged and which is joined to the upper portion (5) by a transition zone (7), inclined downwards and terminates, in its lower part, in a larger diameter region, which forms a bilge keel (8), forming the structure's flat bottom. Internally, it is provided with a central opening (9)—"moonpool", the profile of which follows the external profile of the main body but allows it to be connected with the sea through a lower opening (10) of smaller diameter than the central opening.

As discussed in the above-mentioned document, this lower opening (10) of smaller diameter affords greater equilibrium of the floating structure (1), softening the vertical oscillation movements ("heave") caused by the tides, as it acts in counter-phase with the sea waves. The transition zone (7) acts, damping the angular movements ("pitch") caused by the waves' forces, ensuring greater stability for the structure.

These features are rather desirable in mono-column FPSO structures which operate in very deep water layers and in adverse sea conditions.

The occurrence of hurricanes of great intensity which have arisen in recent times, especially in the Gulf of Mexico, causing great damage on operating platforms, which have large movements and oscillations, present challenges to practitioners in the art.

The mono-column FPSO structure seeks to improve the equilibrium and distribution of forces so they are better spread through the whole structure.

Therefore, this invention in one embodiment proposes a floating structure of the FPSO type, constructed in the form of a mono-column, which embodies and perfects the application of the concept of hydrodynamic compensation between the movements of a floating structure and the movements of seawater which enter in a controlled manner through openings provided in its hull and arranged so that these movements act in counter-phase with one another.

The mono-column FPSO structure of the invention comprises a cylindrical body or a hull, of circular or polygonal horizontal cross-section or a combination of both, wherein at least one load tank is positioned along the vertical central axis of the hull and is surrounded in a radial direction outboard by permanent ballast tanks and moonpools.

For a better understanding of the invention, the arrangements of tanks in a mono-column FPSO structure is schematically shown in FIGS. 2 to 7.

In FIGS. 2 to 5, it is shown horizontal cross-sections of the mono-column FPSO structure or a hull (11) of cylindrical or polygonal form. The load tank (12) is for oil storage and it is positioned along the vertical axis of the hull (11), being surrounded in a radial direction outboard by permanent ballast tanks (13) and moonpools (14) which are positioned laterally one another in an alternating and symmetrical manner. The permanent ballast tanks (13) are considered permanent ballast tanks which are not provided with an opening to the sea. However, these tanks can be provided in their tops, with conventional control devices, such as valves or restrictions for regulation of air into and out.

The individual ones of the moonpools (14) are provided with an opening (15) in their bottom to the sea, which is suitably dimensioned to cause an effective damping action in the mono-column FPSO structure. In their tops, a valve (not shown in the Figures) may be provided to regulate air into and out of the mono-column FPSO structure or there may be a connection by means of a venting tube (16), where air pressure can be applied to, with the aim of increasing efficiency in the attenuation of vertical and angular movements of the mono-column FPSO structure.

Such arrangement of tanks ensures a balanced distribution of forces on the FPSO structure and, consequently, attenuates its movements, giving conditions of dynamically compensating for angular movements ("roll" and "pitch").

Figure 2:
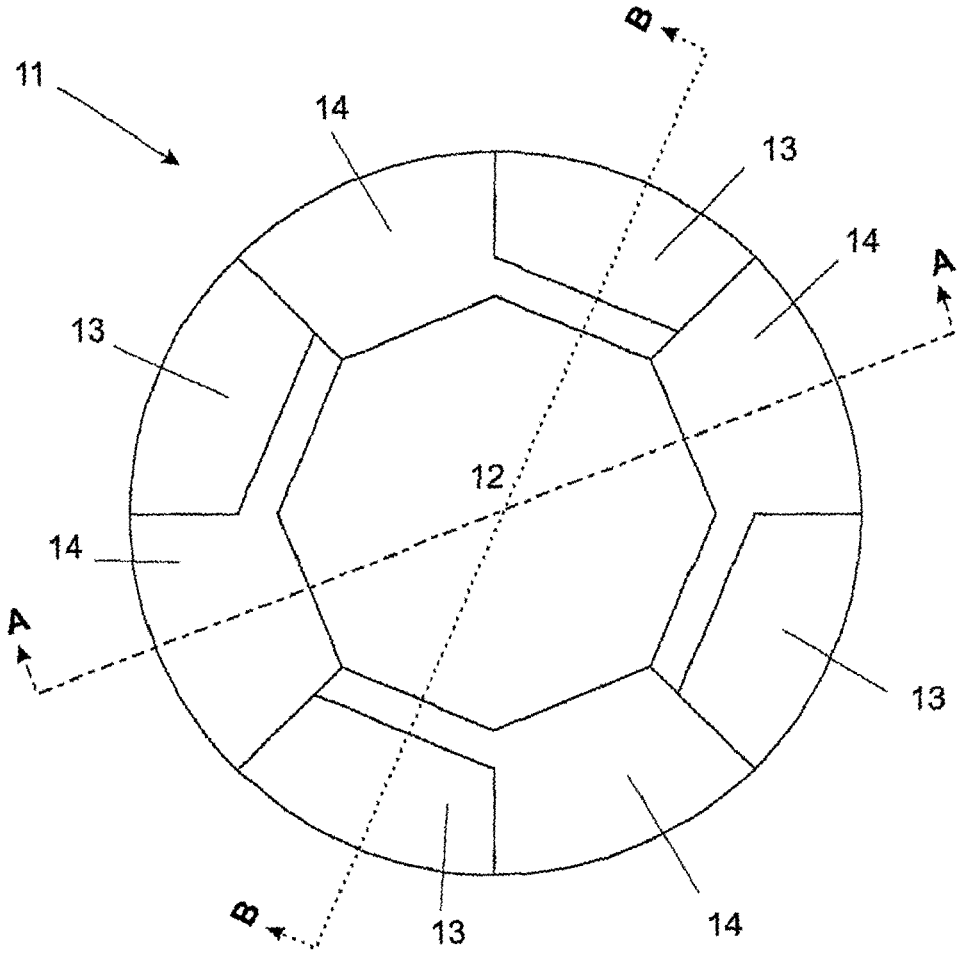
FIG. 2 schematically shows a first embodiment of this invention.

In FIG. 2, it is shown a load tank (12) which is positioned along the vertical central axis of a hull (11), being surrounded in radial direction outboard by permanent ballast tanks (13) and moonpools (14) which are positioned laterally one another in alternating and symmetrical manner, in such a way that the load tank (12) has its sidewall in direct contact with moonpools (14). As an alternative, these permanent ballast tanks (13) and these moonpools (14) can be swapped so that the load tank (12) has its sidewall in direct contact with the permanent ballast tanks (13). The hull (11) can be of circular or polygonal horizontal cross-section or a combination of both.

Figure 3:
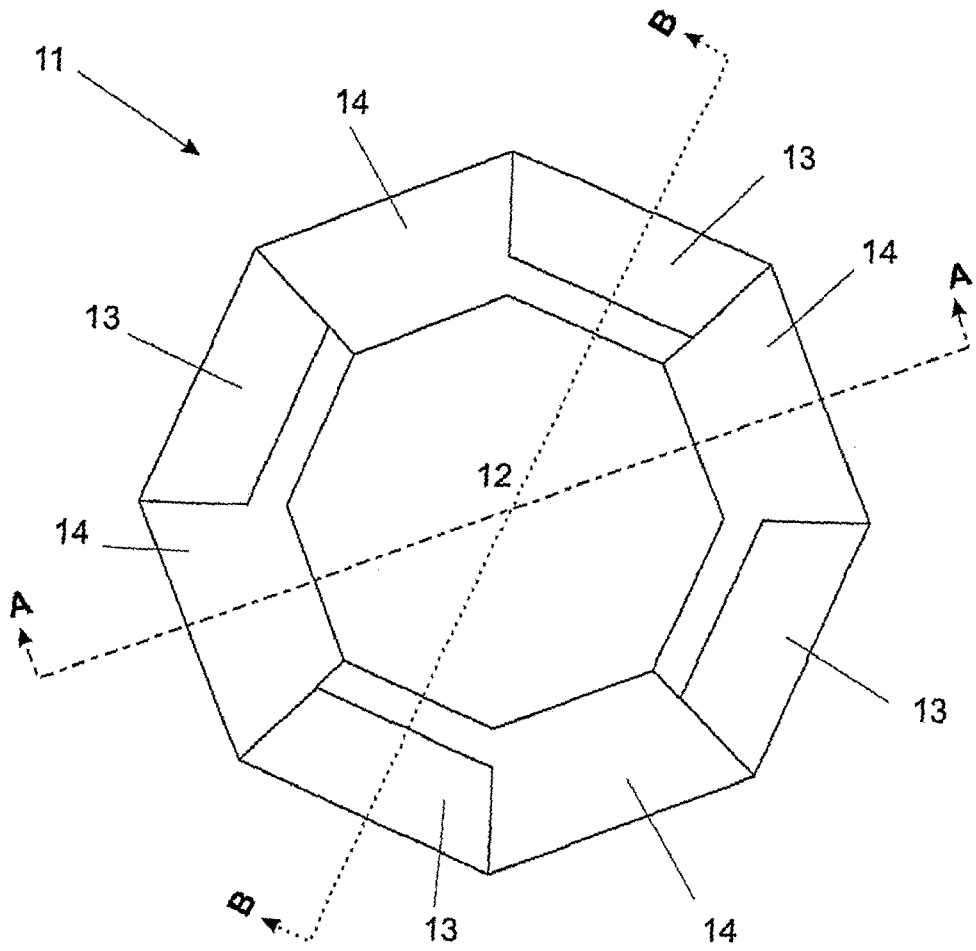
FIG. 3 schematically shows a second embodiment of this invention.

In the arrangement of tanks shown in FIG. 3, the hull (11) has a horizontal cross-section of polygonal form, with a load tank (12) positioned along its vertical central axis and surrounded in a radial direction outboard by permanent ballast tanks (13) and moonpools (14) arranged in such a way that the load tank (12) does not have its sidewall in direct contact with the sea.

Figure 4:
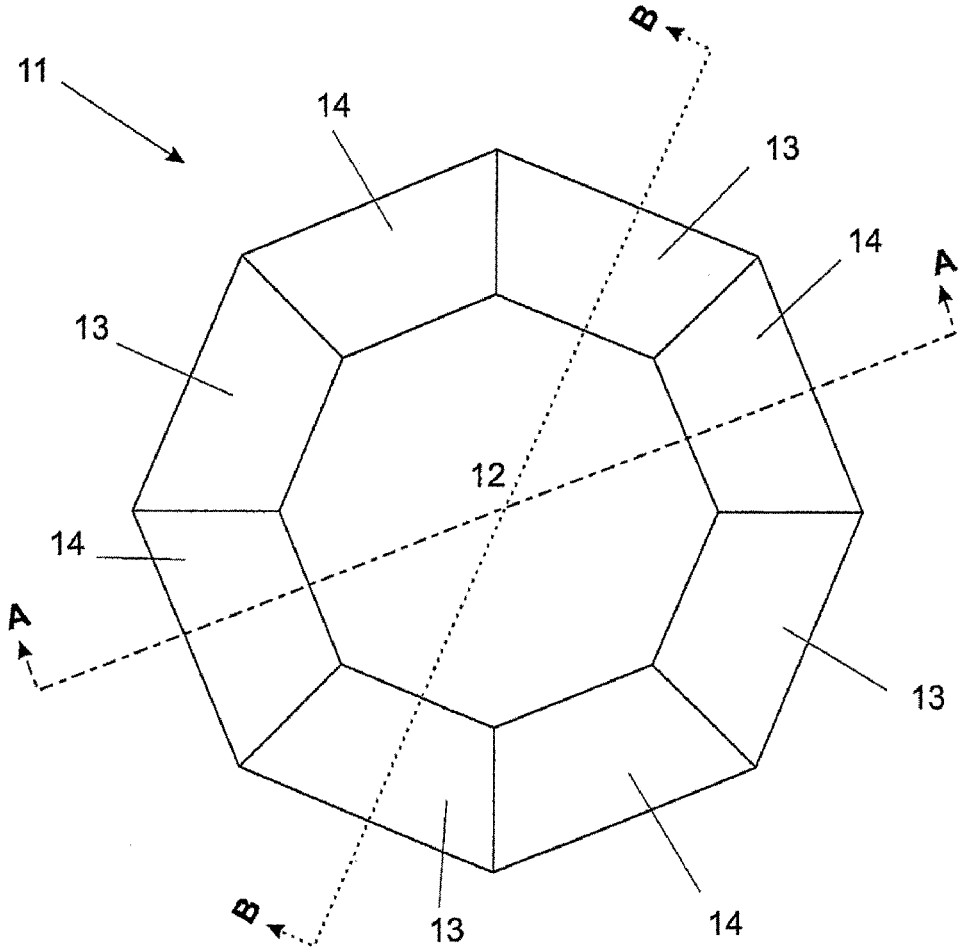
FIG. 4 schematically shows a third embodiment of this invention.

In the arrangement of tanks shown in FIG. 4, the hull (11) has an entirely polygonal horizontal cross-section with the load tank (12) surrounded in a radial direction outboard by permanent ballast tanks (13) and moonpools (14) with no double sidewall surrounding the load tank (12). As illustrated in FIG. 4, the permanent ballast tanks (13) and the moonpools (14) alternate with each other in a circumferential direction around the load tank (12). An advantage of this arrangement of tanks for a mono-column FPSO structure is the saving costs in double sidewall, leaving the load tank (12) far from the regions of possible damage due to collision. To comply with impositions of environmental legislation, the at least one central load tank (12) can be constructed with a double wall in its bottom, preventing the emptying of oil into the sea in the event of damage.

Figure 5:
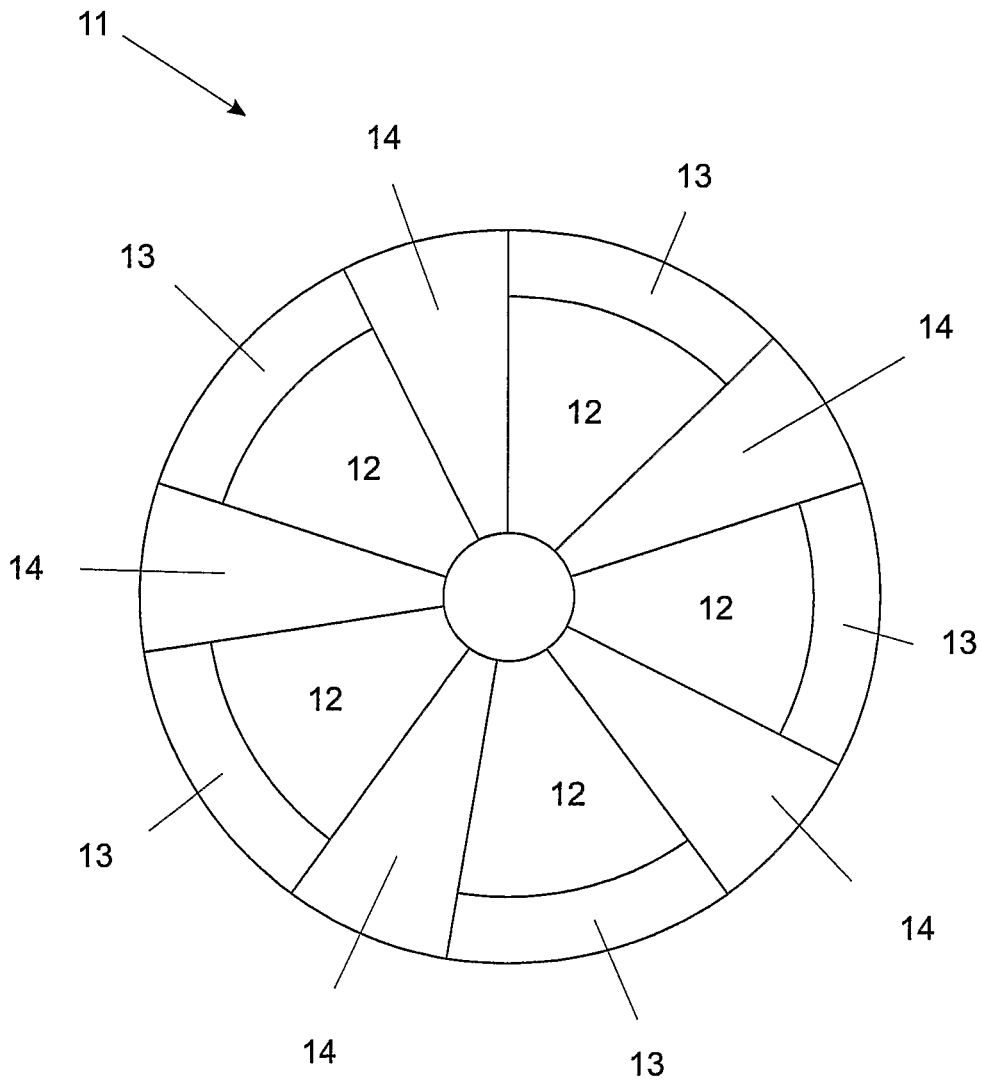
FIG. 5 schematically shows a fourth embodiment of this invention.

Another arrangement of tanks is shown in FIG. 5. In this arrangement, an additional central tank can be utilized for ballast or can remain empty, while more than one load tank (12) are positioned along the central axis in alternating and symmetrical manner with the moonpools (14), while each individual ones of the load tanks is surrounded in a radial direction outboard by the permanent ballast tanks (13), so that each load tank (12) does not have its sidewall in direct contact with the sea.

Therefore, it is shown that the hull (11) can have a circular or polygonal horizontal cross-section or a combination of both, without departing from the scope of the invention.

Another advantage of the arrangement of tanks in radial and alternating positions of the permanent ballast tanks (13) and the moonpools (14) is that it provides a large area for different installations on the FPSO top, preventing them of being over load tanks, thus avoiding huge oscillations due to the impact of sea waves in the lower portion of the mono-column FPSO structures.

Figure 6:
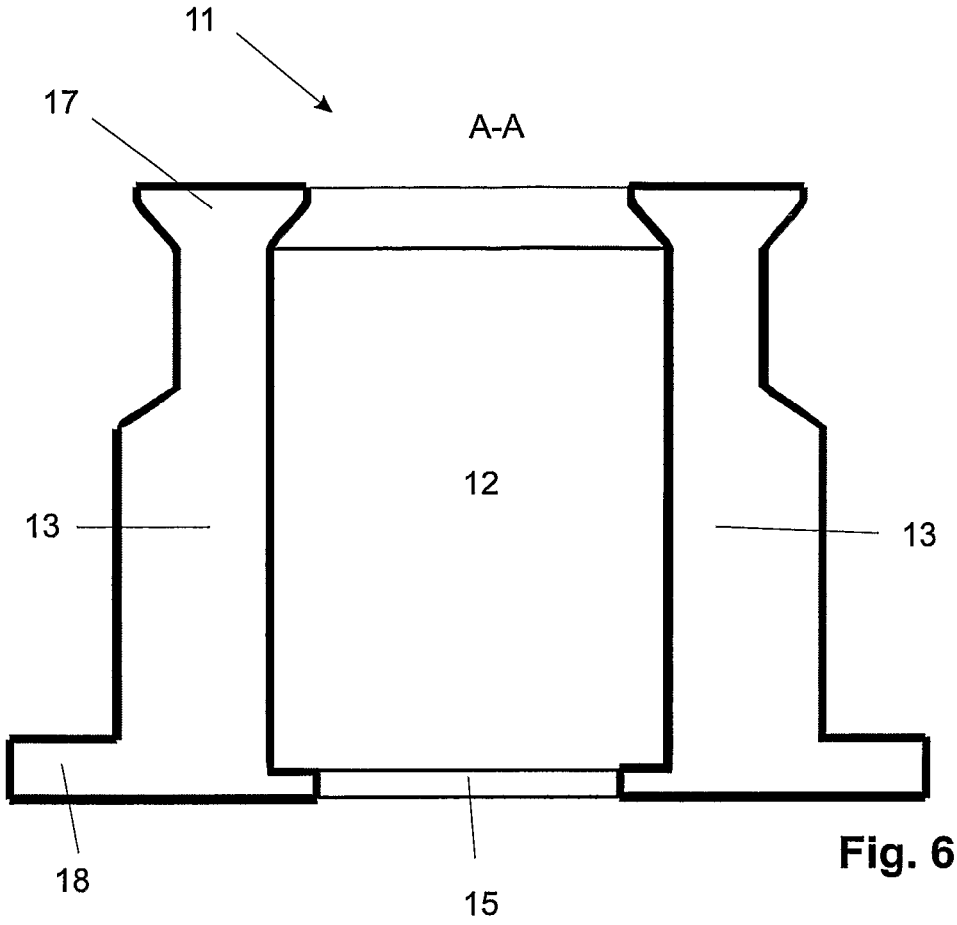
FIG. 6 presents a section A-A which refers to FIGS. 2-4.

FIG. 6 shows a vertical cross section A-A which refers to FIGS. 2 to 4. The cross-section shows the load tank (12) and permanent ballast tanks (13) with their tops 17. Also noted is a widening of their tops (17), which has an advantage in relation to the prior art as it is possible to enlarge the upper area of the hull and to make it available for a deck, in the event of carrying out an operation of the "deck-mating", or "marine-mating" type, i.e. installing the deck on the hull.

Figure 6A:
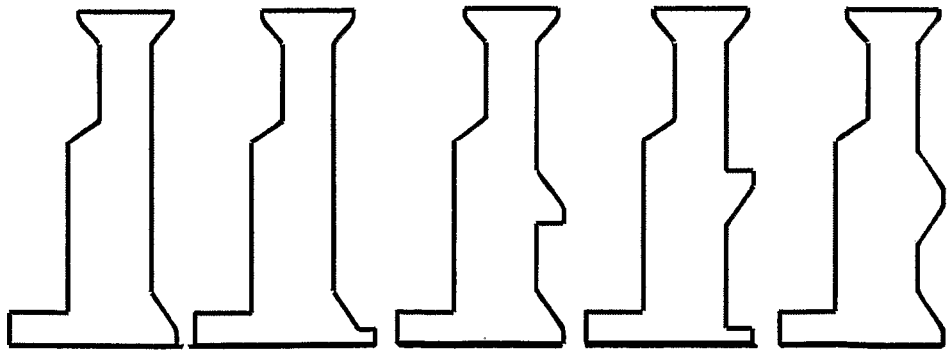
FIG. 6A presents a variation of profiles of the platform of this invention.

Another advantage relates to the "bilge keels" (18) of the lower part of the hull (11). It is possible to design internal and external forms of these bilge keels (18), depending on operational and constructional requirements. FIG. 6A presents possible variations in their forms, but the invention is not limited to these.

As shown in FIG. 6A, the FPSO structure can have more than one "beach" at the level of the main operational draughts, helping to minimize angular movements through variation of the hydrostatic rigidity of the hull. In other words, there can be a larger number of variations of hull diameter in such a way as to have a better response to movement with various different operational draughts, from completely loaded to completely empty. The possibility of many other variations being constructed is clear to a person skilled in the art.

Figure 7:
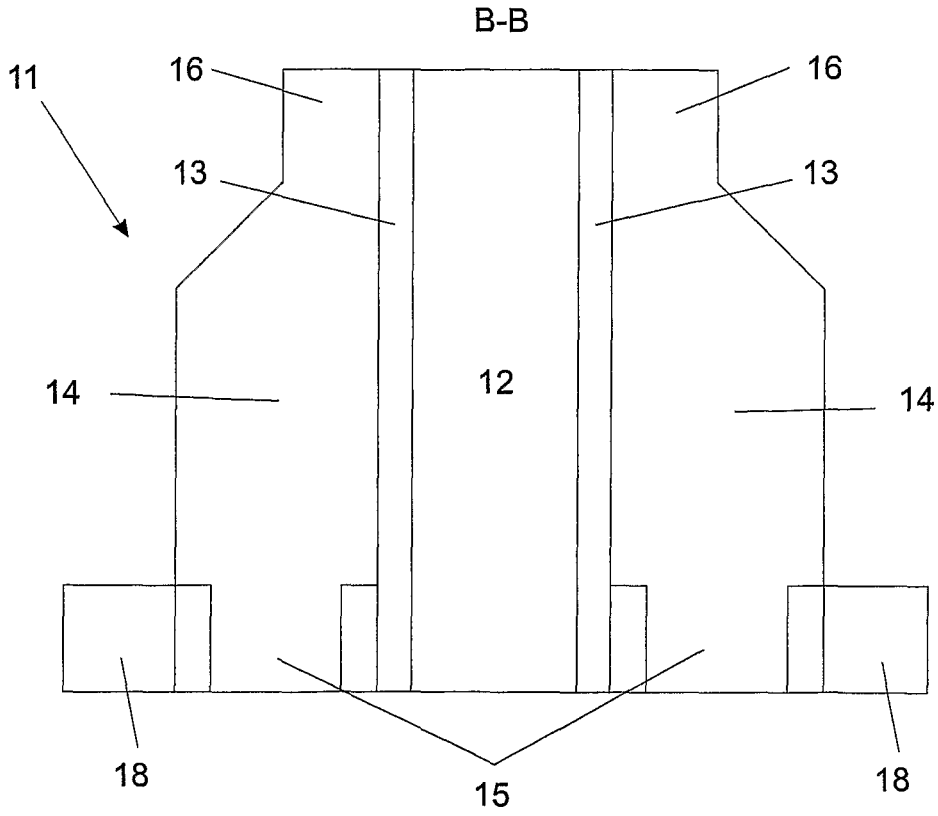
FIG. 7 presents a section B-B which refers to FIGS. 2-4.

The vertical cross-section B-B presented in FIG. 7 which refers to FIGS. 2-4, shows a central load tank (12), permanent ballast tank (13) and moonpools (14), provided with a lower opening (15) to the sea and a venting tube (16) to the outside of the FPSO structure. With suitable adjustment of the dimensions of the lower opening (15), combined with regulation of air into and out of the individual ones of the moonpools (14) to the outside of a mono-column FPSO structure, it is possible to increase the zone of cancellation of undesirable movements, for the situations of calm, average or heavy sea.

It is clear to persons skilled in the art that the central load tank (12) of the invention can be compartmentalized, being capable of fitting a trunk or shaft for accommodating the pumps for ballast or load, as well as the sea chests.

Another advantage of the invention relates to the possibility of better protecting the risers which convey the production fluids from the wells on the sea floor to the platform, because the risers can go up through individual opening (15), thus being protected from damage caused by collision.

To persons skilled in the art, other possibilities of arrangement will be evident, these conforming to the general concept of this invention, positioning the load tanks in the central part of the floating structure and arranging permanent ballast tanks and moonpools alternately, causing the joint action of this arrangement to mitigate angular and vertical movements of the structure.

The outer and inner sides can be cylindrical or polygonal or combinations of these, with longitudinal or radial reinforcement, seeking better adaptation to the construction method to be used.

The invention claimed is:

1. A mono-column floating production, storage and offloading (FPSO) structure of symmetrical polygonal or cylindrical form in relation to a vertical central axis, with an upper portion standing above sea level and a lower portion that is submerged below sea level when in use for offshore petroleum exploitation, the upper portion and the lower portion being joined in a transition zone that is inclined downwards and outwards with respect to the vertical central axis, and terminating in a bilge keel with a flat bottom at a lower end of the lower portion, wherein the FPSO structure comprises a hull (11) of circular or polygonal horizontal cross-section, including at least one load tank (12) having the vertical central axis passing therethrough, and surrounded in a radial direction outboard by permanent ballast tanks (13) and moonpools (14), wherein the permanent ballast tanks and the moonpools are positioned alternately with each other, and disposed symmetrically around the vertical central axis.

2. The mono-column FPSO structure according to claim 1, wherein individual ones of the moonpools (14) have a bottom provided with an opening (15).

3. The mono-column FPSO structure according to claim 1, wherein individual ones of the moonpools (14) have a top provided with a venting tube (16).

4. The mono-column FPSO structure according to claim 1, wherein the at least one load tank (12) is in direct contact with the moonpools (14).

5. The mono-column FPSO structure according to claim 1, wherein the at least one load tank (12) has a horizontal polygonal cross-section.

6. A mono-column floating production, storage and offloading (FPSO) structure of symmetrical polygonal or cylindrical form in relation to a vertical central axis, with an upper portion standing above sea level and a lower portion that is submerged below sea level when in use for offshore petroleum exploitation, the upper portion and the lower portion being joined in a transition zone that is inclined downwards and outwards with respect to the vertical central axis, and terminating in a bilge keel with a flat bottom at a lower end of the lower portion, wherein the FPSO structure comprises a hull (11) of circular or polygonal horizontal cross-section, including permanent ballast tanks (13) and moonpools (14), wherein the permanent ballast tanks and the moonpools are positioned alternately with each other, and disposed symmetrically around the vertical central axis, and radially outward from the vertical central axis, and further including load tanks, which are positioned radially outward from the vertical central axis, wherein the load tanks and the moonpools are positioned alternately with each other around the vertical central axis, and wherein individual ones of the permanent ballast tanks are positioned at an outer radial side of individual ones of the load tanks in relation to the vertical axis.

7. The mono-column FPSO structure according to claim 1, wherein the permanent ballast tanks and the moonpools alternate with each other in a circumferential direction of the at least one load tank (12).

* * * * *